United States Patent [19]

Bullock

[11] 4,187,769

[45] Feb. 12, 1980

[54] APPARATUS FOR FOLDING BOX BLANKS

[75] Inventor: Allen R. Bullock, Stockport, England

[73] Assignee: Simon Container Machinery Limited, Stockport, England

[21] Appl. No.: 895,063

[22] Filed: Apr. 10, 1978

[30] Foreign Application Priority Data

Apr. 19, 1977 [GB] United Kingdom ..... 16117/77

[51] Int. Cl.[2] ..... B31B 1/36

[52] U.S. Cl. ..... 93/52

[58] Field of Search ..... 93/52, 48, 49 R

[56] References Cited

U.S. PATENT DOCUMENTS

| | | | |
|---|---|---|---|
| 3,654,038 | 4/1972 | Hottendorf | 93/52 X |
| 3,992,982 | 11/1976 | Huiskes | 93/52 |

*Primary Examiner*—Gil Weidenfeld

*Attorney, Agent, or Firm*—Norris & Bateman

[57] ABSTRACT

Apparatus for folding box blanks wherein each blank comprises a first portion and one or more further portions to be folded inwardly to lie over the first portion in superimposed relationship therewith the apparatus including a conveyor for carrying the blanks successively through the apparatus during folding and means at the side of the conveyor for progressively manoeuvering the further portion or portions of each blank into the folded position as the blank is conveyed, a pair of elongate flat tongues adjacent the line along which the or each further portion is to be folded so as to hold the blank against the conveying surfaces, the tongues being spaced apart in their upstream region to prevent the further portion from falling inwardly and thus to control the folding movement, the tongues being held apart by a stud while the upper tongue can twist with respect to the lower tongue towards the downstream ends thereof to accommodate the progressively reducing angle between the first portion and the further portion as the latter is folded.

5 Claims, 9 Drawing Figures

APPARATUS FOR FOLDING BOX BLANKS

THIS INVENTION relates to apparatus for folding box blanks.

Rectangular sectioned boxes made from, for example, corrugated board are formed initially as flat blanks which include four panels arranged side-by-side and defined by spaced parallel creases in the blank. These panels form the side walls of the box whilst the top and bottom are formed by flaps one at each end of each panel and defined by creases across the latter. The side edges of the flaps, that is those edges aligned with the creases forming the side edges of the panels, are defined by slots cut in the blank and aligned with what will become the upright corners of the box.

In the production of a box made in this way it is necessary for the two outermost panels of the blank to be folded inwardly to lie in superimposed relationship with the two inner panels so that the outer side edges of the blank move into abutting relationship over the central crease between the two inner panels. Usually a narrow flap forms an extension of one outer panel to overlap with the outer edge of the other outer panel when folded, thus to be joined to the latter by glueing or stapling. When glue is used it is applied to the narrow flap prior to folding of the blank.

A machine for folding box blanks in the manner just described usually comprises a conveyor for carrying the blanks successively through the machine, and an arrangement of guide rails and driven belts adapted, during conveyance of the blank, to maneuvre the outer panels to lie into their intended folded positions over the inner panels. During this folding maneuvre, as the outer panels descend towards their folded positions, there is a tendency for the leading flap of each outer panel to turn inwardly about its crease line under the action of the folding rails or belts. This can result in the outer edges of the outer panels being out of parallelism when folded, and in extreme cases can prevent the blank from being folded at all.

An object of the present invention is to provide apparatus for folding box blanks, wherein the aforementioned difficulty is avoided or at least alleviated, by maintaining the flaps in alignment with their respective panels during the folding process.

According to the present invention there is provided apparatus for folding box blanks wherein each blank comprises a first portion and at least one further portion to be folded inwardly to lie over the first portion in superimposed relationship therewith, the apparatus including means for conveying the blanks successively through the apparatus during folding, means for progressively manoeuvering said further portion of each blank into the said folded position as a blank is conveyed, stationary means disposed to lie, in use, above the blank adjacent a line along which the further portion is to be folded so as to hold the blank against the conveying means, and a pair of elongate flat tongues, one above the other extending along the conveying means and spaced apart in their upstream end regions with respect to the direction of travel of the conveyor, by a member disposed between the opposed faces of the tongues, the tongues tending toward a face-to-face abutting relationship in their downstream end regions portion of the blank as it is folded.

An embodiment of the invention will now be described, by way of example only, with reference to, the accompanying drawings in which.

Figure 2:
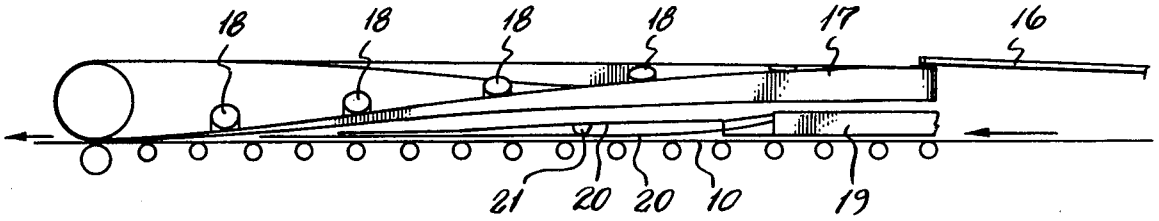
FIG. 2 is an enlarged view taken on line II—II of FIG. 1.
Figure 1:
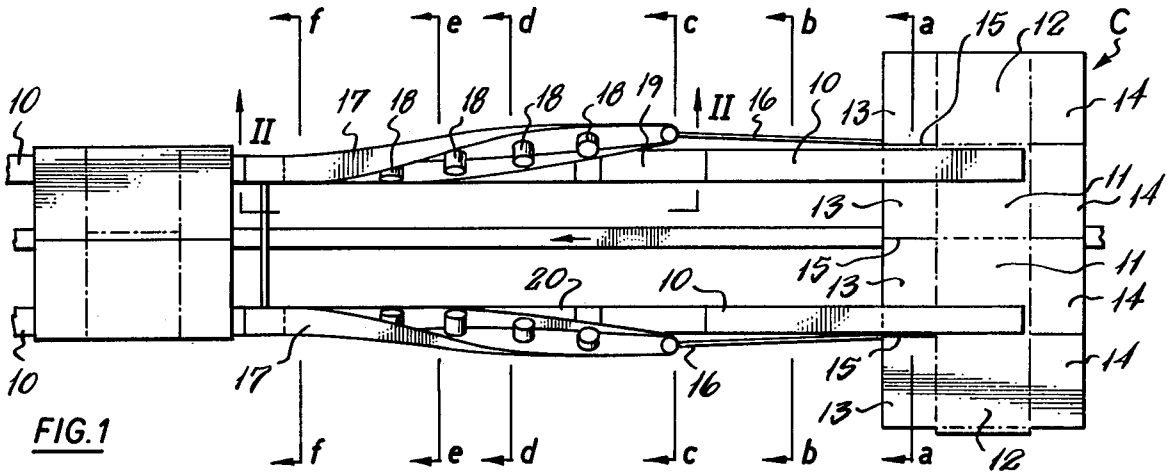
FIG. 1 is a diagrammatic plan view of apparatus for folding box blanks.
Figure 3A:
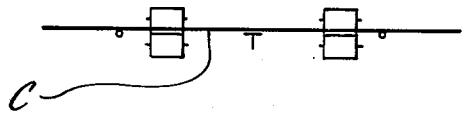
Figure 3B:
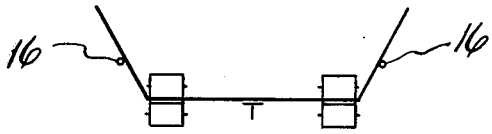
Figure 3C:
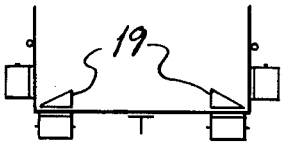
Figure 3D:
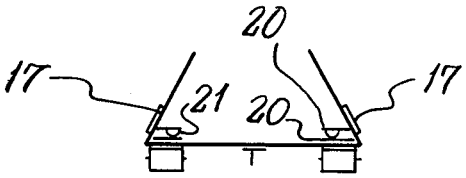
Figure 3E:
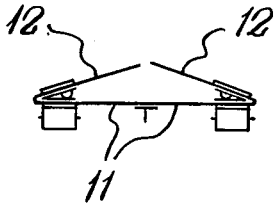
Figure 3F:
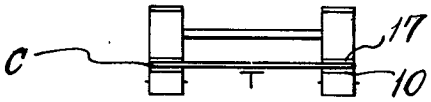
Figure 4:
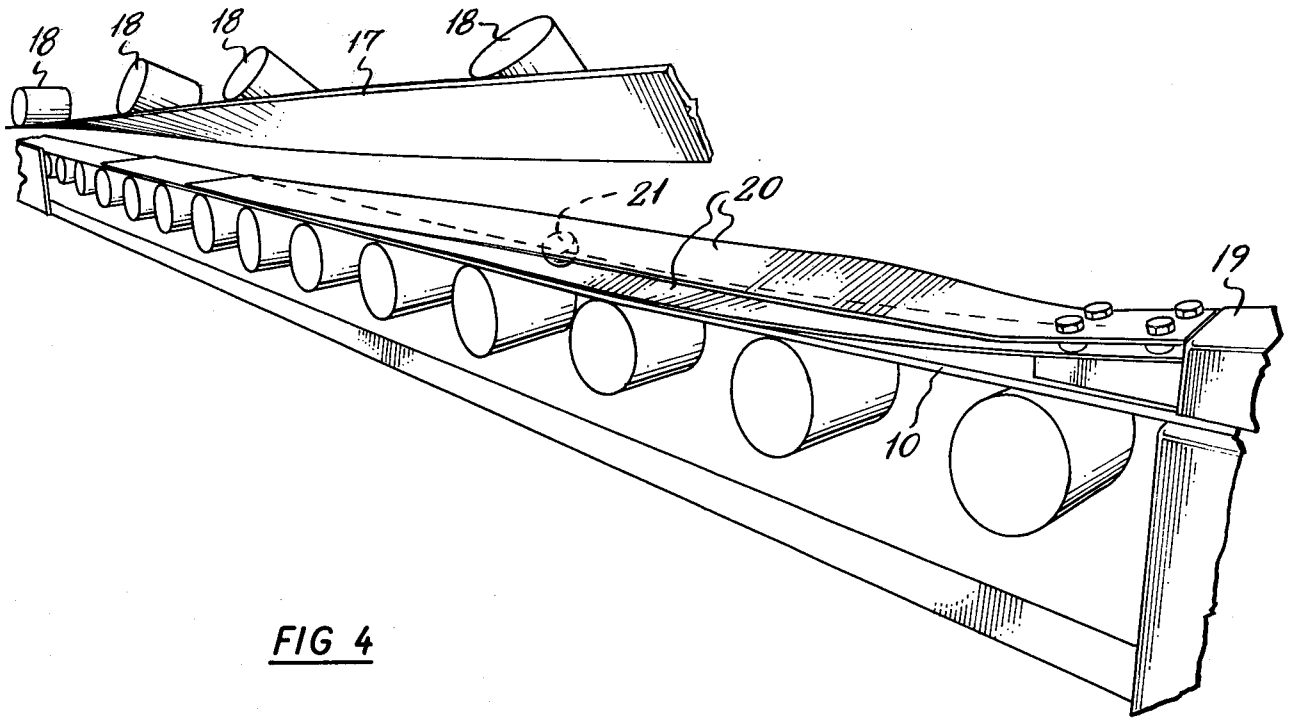

FIG. 3*a* to 3*f* are six views taken on lines a—a to f—f of FIG. 1 showing a box blank in progressive stages of being folded; and FIG. 4 is a perspective view of part of the apparatus of FIG. 1 on an enlarged scale.

Referring now to the drawings, the apparatus comprises a pair of laterally spaced parallel driven conveyor belts 10 for conveying a box blank C, from right to left in FIG. 1, through the apparatus. As can be seen from FIG. 1, the blank comprises a first portion having two inner panels 11, and a further portion having two outer panels 12. These panels 11 and 12 will form the four side walls of the box and are defined with respect to each other by parallel creases in the material of the blank which is usually corrugated paper board. The ends of the box are formed by four loose flaps 13 and 14 defined with respect to their associated panels 11 and 12 by further creases in the blank extending at right angles to the creases defining the panels. Slots 15 are cut in the blank to enable the flaps 13 and 14 to be folded with respect to the panels to form the ends of the box.

On the side of each conveyor belt 10 at the upstream end of the apparatus with respect to movement of the belts is a fixed rail 16 which extends in an upwardly inclined plane in the direction of travel of the conveyor from a position below the level of conveyance to a position above the latter. Extending downstream of each rail 16 is an endless driven belt 17 which wraps around a pair of end rollers and is guided along its length by a series of rollers 18 such that the plane of conveyance of the belt 17 moves progressively from substantially vertical at the upper end of the rail 16, to substantially horizontal near to the downstream end of the conveyor machine. The guide rollers 18 are freely rotatable in any conventional manner on fixed bearing stands which for simplicity in the drawings have not been shown.

As can be seen from FIGS. 1 and 3*a*, in the upstream region of the machine, that is in the region occupied by the rails 16, each conveyor 10 consists of two moving belts, one above and one below the line along which the blanks are to be conveyed. Near the downstream end of the rails 16 each upper conveyor belt is replaced by a stationary guide member 19 which, as can be seen from FIG. 3*c* has a cross section which reduces outwardly. Attached to the downstream end of each guide member 19 is a pair of superimposed elongate flat tongues 20 (see FIG. 4), to be described in greater detail, the guide members 19 and tongues 20 being positioned above each conveyor belt 10 to hold the inner panels 11 and inner flaps 13 and 14 down in contact with the conveyor belts.

The apparatus operates generally in the following manner. The blanks C are fed successively through the machine and during passage therethrough the inner panels 11 are held down on the conveyor belts, and the outer panels 12 together with the outer flaps 13 and 14 are firstly elevated to a vertical position by sliding contact with the rails 16 and thereafter, under the action of the belts 17, they are folded into a horizontal position over the inner panels 11 and inner flaps 13 and 14 to leave the apparatus, as shown at the left-hand end of FIG. 1, in a folded condition. During the folding process, the outer flaps 13 have a tendency, in prior art apparatus of this kind, to fall inwardly towards the centre line of the apparatus as the outer panels 12 descend from vertical to horizontal. The tongues 20 serve to prevent this as will now be described in detail.

Each superimposed pair of tongues is held in spaced apart relationship in its upstream end region by a hemispherical stud 21 fixed to the upper tongue 20 of each pair. It will be noted that the tongues are in face-to-face abutting relationship at their downstream ends, the lower one of the pair being longer than the upper one. The upstanding disposition of the upper tongue 20 in the upstream region thereof holds the adjacent outer flap 13 of each blank in alignment with its associated panel 12 and prevent the flap from pivoting inwardly relative to the panel until the latter has assumed a position sufficiently near to horizontal to prevent the flap from tending to turn inwardly. Towards the downstream ends of the tongues 20, the upper tongue 20 tends to twist about a generally longitudinal axis thereof so that the outer edges of each pair of tongues move into abutting relationship. This effect is achieved gradually along the length of the tongues from the upstream end.

The folding action is shown diagrammatically in FIGS. 3*a* to 3*f* where it will be seen that the inclined rails 16 cause the outer panels 12 to be raised from the horizontal position in FIG. 3*a* to the vertical position in FIG. 3*c*. Thereafter the panels are moved inwardly and downwardly by the belts 17 as can be seen in FIGS. 3*d* to 3*f*. In FIG. 3*d* the tongues 20 are held in spaced relationship by the stud 21 to prevent the flaps 13 from turning inwardly. However, in the position shown in FIG. 3*e*, the upper tongues have twisted to permit the reducing angle between the panels 11 and 12 to be accommodated. By the time the panels reach the position illustrated in FIG. 3*f*, the tongues 20 of each pair are in face-to-face abutting relationship and the blank assumes the flat position illustrated at the left-hand end of FIG. 1.

The tongues 20 are provided with smooth surfaces and are preferably made from sprung steel.

It is not intended to limit the invention to the above example only, many variations, such as might readily occur to one skilled in the art, being possible without departing from the scope of the invention as defined by the apended claims.

For example, the stud 21 may be replaced by a plurality of studs extending over that portion of the length of the tongues 20 where it is required for the upper tongue to be supported above and substantially parallel to the lower tongue. Furthermore, the or each stud 21 may be fixed to the lower tongue if preferred.

What is claimed is:

1. Apparatus for folding box blanks wherein each blank comprises a first portion and at least one further portion to be folded inwardly to lie over the first portion in superimposed relationship therewith, the apparatus including means for conveying the blanks successively through the apparatus during folding, means for progressively manoeuvering said further portion of each blank into the said folded position as the blank is conveyed, stationary means disposed to lie, in use, above the blank adjacent a line along which the further portion is to be folded so as to hold the blank against the conveying means, and a pair of elongate flat tongues, one above the other, extending along the conveyor and spaced apart in their upstream end regions with respect to the direction of travel of the conveyor, by a member disposed between the opposed faces of the tongues, the tongues tending towards a face-to-face abutting relationship in their downstream end regions.

2. Apparatus for folding box blanks according to claim 1, wherein said conveying means comprises a pair of parallel driven conveyor belts.

3. Apparatus for folding box blanks according to claim 1 wherein said manoeuvering means comprises a stationary rail disposed at the side of said conveying means and inclined upwardly and inwardly with respect thereto in the direction of travel thereof, and a driven belt disposed downstream of said stationary rail, said belt being guided such that its plane moves progressively from substantially vertical to substantially horizontal in the direction of travel of the conveyor.

4. Apparatus for folding box blanks according to claim 1, wherein said tongues extend part way along said conveying means and said member comprises a hemispherical stud attached to one of said tongues and disposed with its curved surface in contact with the other of said tongues.

5. Apparatus for folding box blanks according to claim 1, wherein said elongate flat tongues are made from sprung steel.

* * * * *